US008251251B2

(12) United States Patent
Arvidsson et al.

(10) Patent No.: US 8,251,251 B2
(45) Date of Patent: Aug. 28, 2012

(54) CONTAINER

(75) Inventors: Lars Arvidsson, Lund (SE); Lena Axelson-Larsson, Södertälje (SE); Maria Benktzon, Bromma (SE); Thomas Nilsson, Bromma (SE); Ulrika Vejbrink, Bromma (SE)

(73) Assignee: AstraZeneca AB (SE)

( * ) Notice: Subject to any disclaimer, the term of this patent is extended or adjusted under 35 U.S.C. 154(b) by 1098 days.

(21) Appl. No.: 11/624,314

(22) Filed: Jan. 18, 2007

(65) Prior Publication Data

US 2007/0170191 A1 Jul. 26, 2007

(30) Foreign Application Priority Data

Jan. 20, 2006 (SE) ..... 0600126-7
Jun. 29, 2006 (SE) ..... 0601425-2

(51) Int. Cl.
*B65D 51/04* (2006.01)

(52) U.S. Cl. ..... 220/813; 215/213

(58) Field of Classification Search ..... 220/813, 220/254.9, 345.1, 811, 812, 815, 816, 849, 220/284; 215/206, 220, 223, 213; 206/703, 206/823, 1.5; 16/364, 362, 363; 70/63
See application file for complete search history.

(56) References Cited

U.S. PATENT DOCUMENTS

| | | | | |
|---|---|---|---|---|
| 191,503 | A | 5/1877 | Wiseman | |
| 596,646 | A | 1/1898 | Altshul | |
| 1,421,219 | A | 6/1922 | Harmon | |
| 1,653,293 | A * | 12/1927 | Kendall | 220/812 |
| 2,636,469 | A | 4/1953 | McKay | |
| 3,024,899 | A * | 3/1962 | Reitzel | 206/1.5 |
| 3,735,099 | A | 5/1973 | Herr | |
| 4,037,719 | A | 7/1977 | Perlmutter | |
| 4,535,903 | A | 8/1985 | Franchi | |
| 4,848,627 | A * | 7/1989 | Maeda et al. | 224/275 |
| 4,971,203 | A | 11/1990 | Weinstein | |
| 5,271,353 | A | 12/1993 | Besthorne | |
| D344,889 | S | 3/1994 | Kozlowski et al. | |
| 5,372,267 | A | 12/1994 | Hofmann | |
| 5,562,331 | A * | 10/1996 | Spykerman et al. | 297/188.16 |
| 5,586,087 | A | 12/1996 | Silverson | |

(Continued)

FOREIGN PATENT DOCUMENTS

| | | | |
|---|---|---|---|
| EP | 609 954 | B1 | 7/1998 |
| EP | 609954 | B1 | 7/1998 |
| GB | 998 148 | | 7/1965 |
| WO | WO-2004/041671 | A1 | 5/2004 |
| WO | WO 2004/041671 | A1 | 5/2004 |

OTHER PUBLICATIONS

U.S. Appl. No. 11/755,105, Mar. 30, 2007, Arvidsson et al.

(Continued)

*Primary Examiner* — Anthony Stashick
*Assistant Examiner* — Jeffrey Allen
(74) *Attorney, Agent, or Firm* — Finnegan, Henderson, Farabow, Garrett & Dunner, L.L.P.

(57) ABSTRACT

The present invention relates to a container for solids or liquid and a method of opening a container. The container comprises a hollow body which holds the contents and a closure which cooperates with the body to close the container. The closure comprises an opening member which is movable from a retracted position to an opening position in which the closure can be opened. The container further comprises a locking member for securing the opening member, the locking member being movable between a locking position in which the opening member is kept secured in the retracted position and an unlocked position in which the opening member is movable into the opening position.

18 Claims, 7 Drawing Sheets

U.S. PATENT DOCUMENTS

| | | | | |
|---|---|---|---|---|
| 5,683,008 | A | 11/1997 | Galer | |
| 5,699,900 | A | 12/1997 | Artis | |
| D397,247 | S | 8/1998 | Gardner et al. | |
| 5,908,125 | A | 6/1999 | Opresco | |
| 5,975,010 | A | 11/1999 | Marshall | |
| 6,016,764 | A | 1/2000 | Giveen | |
| 6,045,173 | A * | 4/2000 | Tiesler et al. | 296/37.8 |
| 6,082,572 | A | 7/2000 | Galton-Fenzi et al. | |
| 6,152,067 | A | 11/2000 | Mathison | |
| D515,804 | S | 2/2006 | Chue | |
| D516,420 | S | 3/2006 | Teo | |
| D528,288 | S | 9/2006 | Coe et al. | |
| D540,162 | S | 4/2007 | Chin et al. | |
| 2003/0136753 | A1 * | 7/2003 | Biesecker et al. | 215/224 |
| 2006/0124501 | A1 | 6/2006 | McNeely | |
| 2007/0170191 | A1 | 7/2007 | Arvidsson et al. | |

OTHER PUBLICATIONS

U.S. Appl. No. 29/278,455, Mar. 30, 2007, Arvidsson et al.
U.S. Appl. No. 29/278,449, Mar. 30, 2007, Arvidsson et al.
U.S. Appl. No. 11/624,314, Jan. 18, 2007, Arvidsson et al.

* cited by examiner

CONTAINER

TECHNICAL FIELD

The present invention relates to a container which can hold tablets or liquids, for example, for use in the pharmaceutical, chemical and food industries and in particular to a child resistant locking arrangement for a container. The invention also relates to a method of opening a child-resistant container.

BACKGROUND OF THE INVENTION

Containers that have child resistant features are now generally available but these containers are typically very difficult for elderly or disabled persons to open. Reference should now be made to U.S. Pat. No. 5,908,125 and other patents in the same area of technology. In general, child resistant containers require the user to simultaneously squeeze and turn the closure, or push and turn the closure, in order to release the closure is from the container body. However, elderly persons or persons with dexterity problems find that the force required to squeeze or push the closure and simultaneously rotate the closure is too great or that they experience pain in attempting to open the closure. Those suffering from rheumatoid arthritis and osteoarthritis will find that they have to avoid any movement, which involves gripping, twisting or bending of the wrist.

U.S. Pat. No. 4,535,903 describes a medicine vial having a cap which is provided with a recess and complimentary slots and inner chamber whereby a panel may be slidable into and out of the cap. When the panel is fully inserted into the cap, there are no projections on the cap for facilitating removal of the cap from the vial. When fully retracted from the cap, the panel permits the user to raise the cap thus permitting access to the vial. Even though the cap can only be opened after sliding the panel out from the cap geometry, the panel is not locked for children to play with. This means that if a child accidentally slides out the panel, the container can then be opened.

THE OBJECT OF THE INVENTION

An object of the present invention is to provide a container that overcomes or alleviates the drawbacks of the known devices and which provides a container that is easy to open, in particular, for elderly and disabled persons and that the container is child resistant. In this way, the intended user will easily get access to the content of the container but at the same time a high entry barrier is provided for children.

SUMMARY OF THE INVENTION

The above mentioned object is achieved by providing a container for solids or liquid comprising a hollow body which holds the contents and a closure which cooperates with the body to close the container, the closure comprises an opening member which is movable from a retracted position to an opening position in which the closure can be opened. The container further comprises a locking member for securing the opening member, the locking member being movable between a locking position in which the opening member is kept secured in the retracted position and an unlocked position in which the opening member is movable into the opening position.

The main advantage with the invention is that it provides a container with a high entry barrier for children and at the same time it is senior friendly and also suitable for disabled persons, e.g. people suffering from arthritis or other hand impediments. This advantage is achieved by the "double action child resistant feature". Firstly, the locking member must be moved to the unlocked position. Secondly, the opening member can be moved, e.g. slided into the opening position and the container can now be opened.

According to at least one embodiment of the invention, the locking member is movable with respect to both the body and the closure.

According to at least one embodiment of the invention, there is provided an actuator means that automatically moves the locking member from the unlocked position back to the locked position. This means that the child resistant feature is always active when the closure is closed after use and without the user having to manually move the locking member back to the locked position.

According to a first embodiment of the invention, there is provided an actuator means that automatically moves the locking member from the unlocked position back to the locked position as the opening member of the closure is moved back to the retracted position from the opening position. As the container of a first embodiment of the invention is closed after use and the opening member is slided back to the retracted position, it simultaneously and automatically moves the locking part back to its locking position.

According to a first embodiment of the invention, the actuator means comprises a protruding part on the locking member which co-operates with a protruding edge on the opening member to move the locking member from the unlocked position to the locked position as the opening member is moved back to its retracted position.

According to a first embodiment of the invention, the protruding part is resiliently attached onto the locking member.

According to a second embodiment of the invention the actuator means comprises at least one spring member arranged on the locking member to automatically move the locking member from the unlocked position to the locked position. In the second embodiment of the invention the locking member is automatically moved back to the locked position as soon as the opening member has been slided out to the opening position. Thus, as the container is closed after use and the opening member is slided back to the retracted position, the locking member is already in the locked position and the opening member is therefore locked in the retracted position.

According to at least one embodiment of the invention, the closure further comprises a lid onto which lid the opening member is slidable mounted.

According to at least one embodiment of the invention, the lid comprises a first section fixed to the body and a second section which is snap fitted to the body.

According to at least one embodiment of the invention, the first and the second sections of the lid are pivotally arranged to each other via a hinge.

According to at least one embodiment of the invention, the second section of the lid is provided with a sealing ring for sealing the access hole of the container.

According to at least one embodiment of the invention, the opening member is provided with at least one lip that fit into at least one indentation in the container when the opening member is in the retracted position. The locking member locks the opening member such that it cannot be moved in the lateral direction and the lip engaged in indentation are means provided to secure the opening member from any longitudinal movement in the retracted position.

According to a first embodiment of the invention, the opening member and the locking member are provided with indication marks.

According to a first embodiment of the invention, the indication marks on the opening member and the locking member respectively are aligned in the unlocked position.

According to a first embodiment of the invention, the indication marks on the opening member and the locking member respectively are not aligned in the locked position.

According to a first embodiment of the invention, the indication marks are protruding from the material of the container such that they can be felt by touch. The tactile means are provided, i.e. indications that can be felt by touch to facilitate the handling of the container when the vision is poor, i.e. in darkness or for users that are weak-sighted.

According to at least one embodiment of the invention, a method is provided for opening a container for solids or liquid comprising a hollow body which holds the contents and a closure which cooperates with the body to close the container, the closure comprises an opening member, and a locking member for locking the opening member, the method comprising the following steps;

moving the locking member to an unlocked position, moving the opening member from a retracted position to an opening position, and opening the closure of the container by lifting the opening member.

The force required to open the closure is very small, which means that turning a cap together with applying a force (press or push) is avoided. Any hand movement including grip, twist or bending the wrist is also avoided.

According to a first embodiment of the invention moving the locking member involves turning a locking ring to the unlocked position.

According to a second embodiment of the invention moving the locking member involves depressing a locking button to the unlocked position.

BRIEF DESCRIPTION OF THE DRAWINGS

The present invention will now be described, for exemplary purposes, in more detail by way of embodiments and with reference to the enclosed drawings, in which.

DETAILED DESCRIPTION OF PREFERRED EMBODIMENTS

Figure 1:
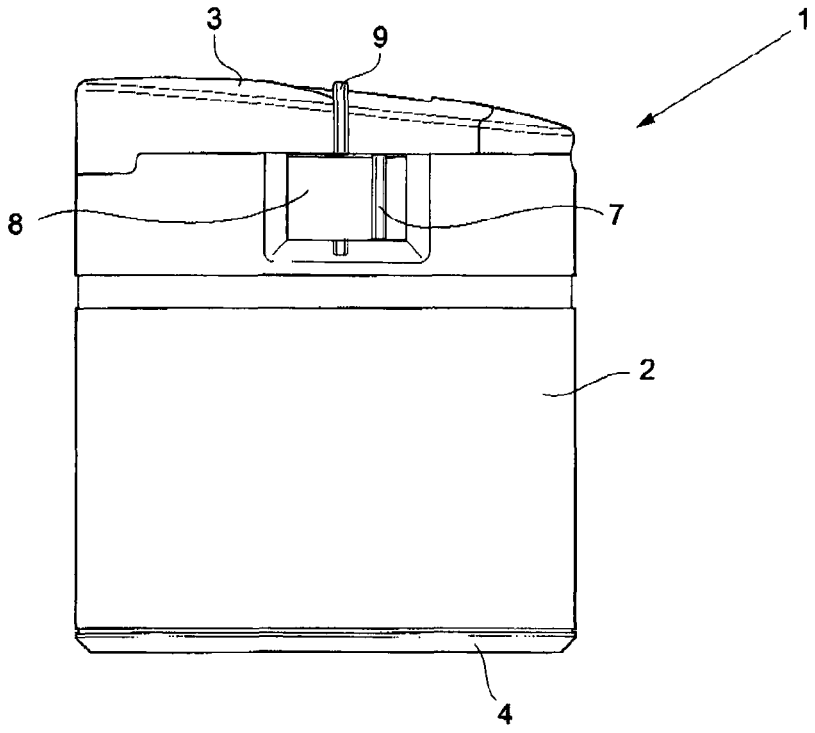
FIG. 1 shows a side-view of a first embodiment of the container in the locked position.
Figure 2:
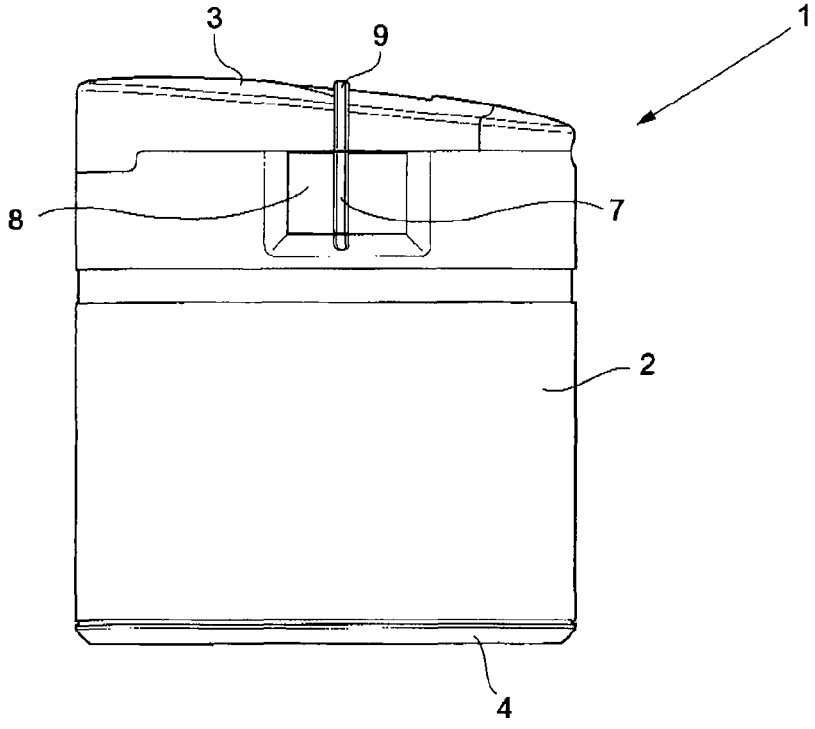
FIG. 2 shows a side-view of a first embodiment of the container in the unlocked (but closed) position.

In FIGS. 1 and 2, a container according to a first embodiment of the invention is shown. The container 1 comprises a hollow body 2 for holding a solid content, such as tablets, or a liquid content, a closure 3 for closing the container and a locking member 8. The hollow body 2 is a tubular form having one end closed by a base wall 4 and an opposite neck end partially covered by an upper wall 5 formed with an access hole 6. The bottom of the container, the base wall and/or lower parts of the hollow body may be transparent, making it possible with visual judgment of number of tablets remaining. The closure 3 of the container comprises a lid 20 for sealing of the opening of the container, i.e. the access hole 6, and an opening member 10 functioning as a lever for opening the closure, see FIGS. 3 and 4. The closure may be adapted to any kind of design of the container, i.e. flat, square, round can be used. Preferably, the container is slim to facilitate the handling of it for people with severe arthritis or other hand impediments, as they suffer from difficulties of gripping large objects.

Turning again to FIGS. 1 and 2, the opening member 10 and the locking member 8 are provided with indication marks 7, 9, which indicate specific positions of the opening member and locking member respectively. In FIG. 1 the indicator mark 7 on the locking member are not aligned with the indication mark 9 on the opening member, which means that the opening member is locked by the locking member in its retracted position. Thus, FIG. 1 illustrates the closed and locked condition of the container. FIG. 2 illustrates the closed but unlocked condition of the container. The indicator marks are aligned indicating that the opening member is free to move. Thus, the opening member can be moved from the retracted position to the opening position showed in FIG. 3. The closure can now be opened by lifting or flipping the extended distal end 11 of the opening member 10.

Figure 3:
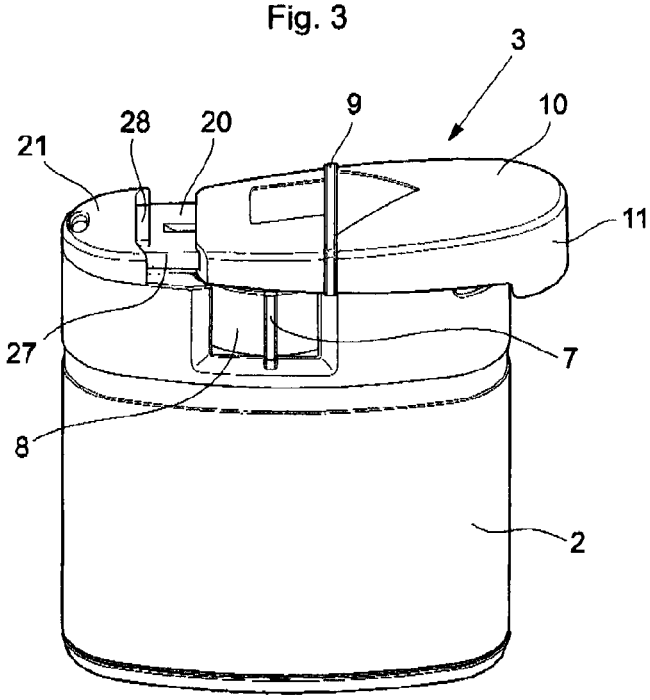
FIG. 3 illustrates a perspective view of a first embodiment of the container in the opening position.

In FIG. 3, the opening member 10 has been slided out to the opening position and the opening member can now be used as a lever for opening the container and thereby minimising the force required to open the closure 3. The lid 20 comprises a first section 21 fixed to the hollow body 2 and a second section 27, which is pivotally arranged to the first section around a hinge 28. A part of the lid 20 and the hinge 28 is now visible under the opening member 10 in FIG. 3. As the closure is lifted to be opened, the second section 27 of the lid 20 pivots around the hinge 28, e.g. the closure is not removed from the container when it is opened. The hinge is preferably a so-called living hinge.

Figure 4:
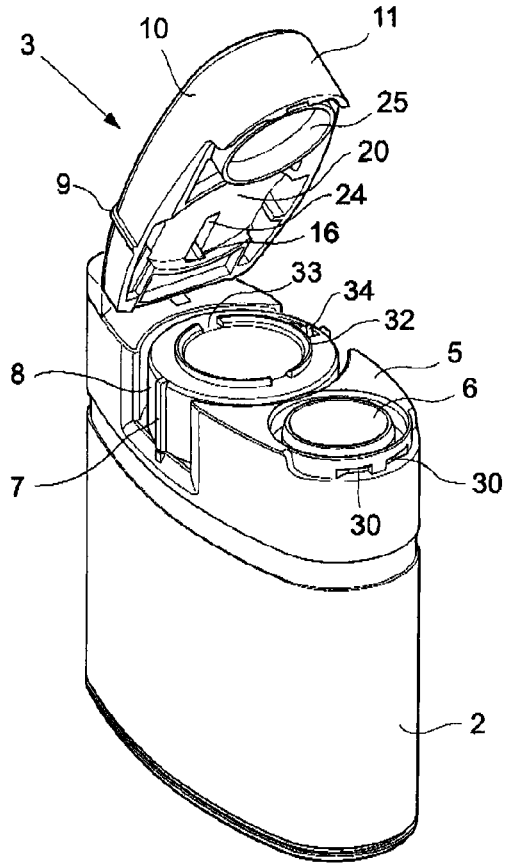
FIG. 4 illustrates a perspective view of a first embodiment of the container with the closure opened.

In FIG. 4 the closure 3 is fully opened and an object can be taken out from the container by tilting it. The closure is a snap cap, which is tight and is easily opened by using both hands or by using one hand and, for example a table edge. On the lid 20 an efficient seal is provided by the sealing ring 25 to be fitted into or outside the access hole 6 when the lid is closed on the container. In the upper distal end of the container, just under the access hole, small indentations 30 can be seen into which lips 14 are fitted when the opening member is in the retracted position. This feature further secures the closure in the retracted position. The lips 14 engaged in indentations 30 are means provided to the container to see to that the closure remains closed even if tampered with. The number of lips and indentations are chosen in respect of the size and form of the closure and hollow body respectively.

Figure 6:
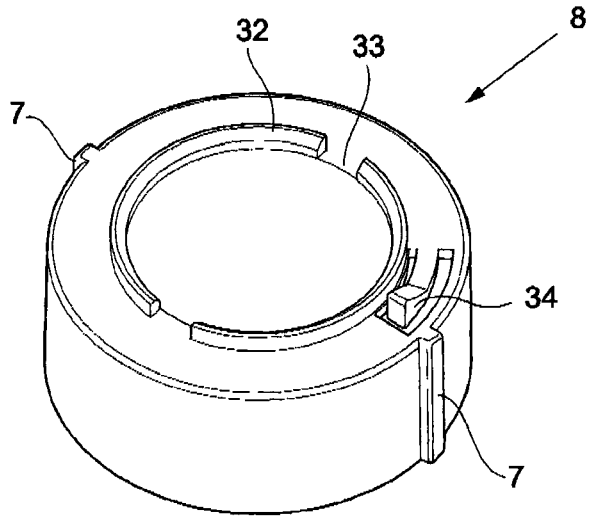
FIG. 6 illustrates a perspective view of a first embodiment of the locking member.

FIG. 4 also shows the locking member, preferably being a locking ring 8, which is freely rotatable in respect of both the hollow body 2 and the closure 3. FIG. 6 shows the locking ring 8 in detail. With reference to both FIGS. 4 and 6, the locking ring is provided with a circular ridge 32 having at least one opening 33 in it. The outer periphery of the ridge 32 is perpendicular to top surface of the locking ring and the inner periphery of the ridge 32 shows a sloping surface. When the locking member is in its locking position on the closed container, the outer periphery of the ridge 32 stops any movement of the opening member 10 from its retracted position. At least one projection 16 on the inside of the opening member is stopped by the ridge 32 and prevents the opening member from moving from the retracted position. When the locking member is in its unlocked position, the opening member may be slided out to the opening position as the projection 16 on the opening member now can pass through the opening 33 in the ridge on the locking member. However, due to the sloping design of the projection 16, which can be seen in FIG. 7, and the likewise sloping design of the inner surface of the ridge 32, the projection 16 may pass over the ridge 32 as the opening member is pushed back to the retracted position without necessarily pass through the opening 33 on the way back.

In the embodiment shown in FIG. 4, one projection 16 is provided on the inside of the opening member. However, in another embodiment (not shown) two projections are provided on the inside of the opening member. In that embodiment, at least two openings 33 in the ridge 32 must be provided and also two grooves 24 in the lid. The projection 16 on the inside of the opening member is slightly elongate but can otherwise have any suitable shape.

Figure 5:
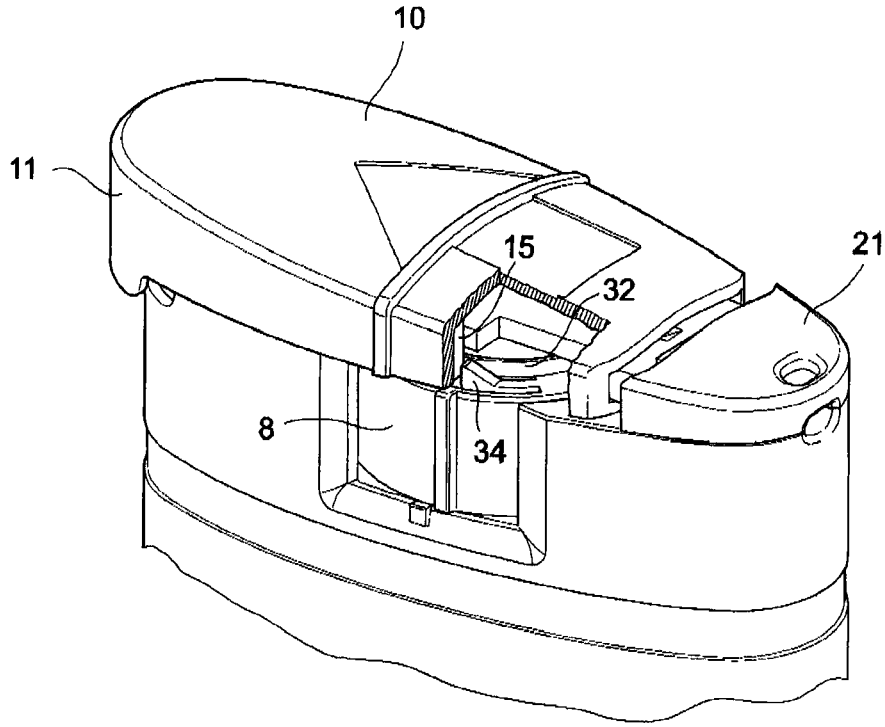
FIG. 5 shows a perspective view of the top of the container of a first embodiment having a piece of the lid cut out showing details on the locking member.

In FIG. 5 the locking member 8 is shown through a cut out in the opening member and a protruding part 34 can been seen arranged on the locking ring 8, which is a part of the actuator means 34, 15 that automatically moves the locking member from the unlocked position back to the locked position as the opening member is moved back to the retracted position after the container has been closed. When the lid is closed and the opening member is slided back to the retracted position, a protruding edge 15 on the inside of the opening member engages with the protruding part 34 on the locking member 8 and the locking member is turned to the locking position at the same time as the opening member is moved back to its retracted position. Preferably, the protruding part 34 is resiliently arranged on the locking member such that it will gently bend down allowing the opening member to be slided out into the opening position. However, the protruding part 34 may instead be arranged in the opposite direction on the locking ring such that the locking member 8 is moved away from the unlocked position to a locked position already when the opening member is slided out into the opening position. Accordingly, the resiliently arranged protruding part 34 will gently bend down when the opening member is to be moved back to the retracted position.

Figure 7:
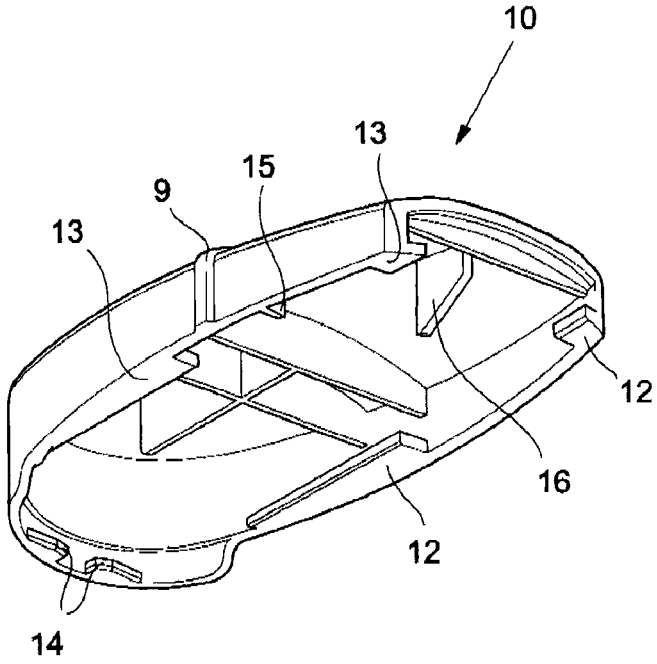
FIG. 7 illustrates a perspective view from underneath of the opening member of a first embodiment.
Figure 8:
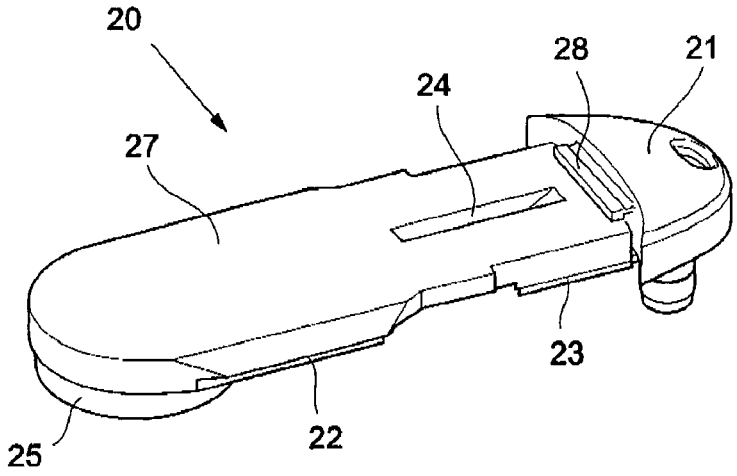
FIG. 8 illustrates a perspective view of a first embodiment of the lid.

FIG. 7 and FIG. 8 show the opening member 10 and the lid 20 respectively. When mounted on the container 1, the opening member 10 is slidably attached to the lid 20 and together they form the closure 3. The arrangement being such that the opening member is slidable in a lateral direction across the lid. The opening member comprises two flanges 12, 13 that extend along the respective longitudinal edges of the opening member. The two elongate flanges of the opening member are each arranged around edges 22,23 provided along the respective longitudinal sides of the lid 20. Further, the lid has an elongate groove 24 for receiving the projection 16 such that the opening member can slide over the lid when the locking member is in the unlocked position.

In FIGS. 9 to 14, a container according to a second embodiment of the invention is shown. Structurally, the container in accordance with the second embodiment has many features in common with the container of the first embodiment described above. For this reason and in order to avoid duplication of description, only the structural differences will be described in detail and reference is made to the preceding description of the first embodiment.

Figure 9:
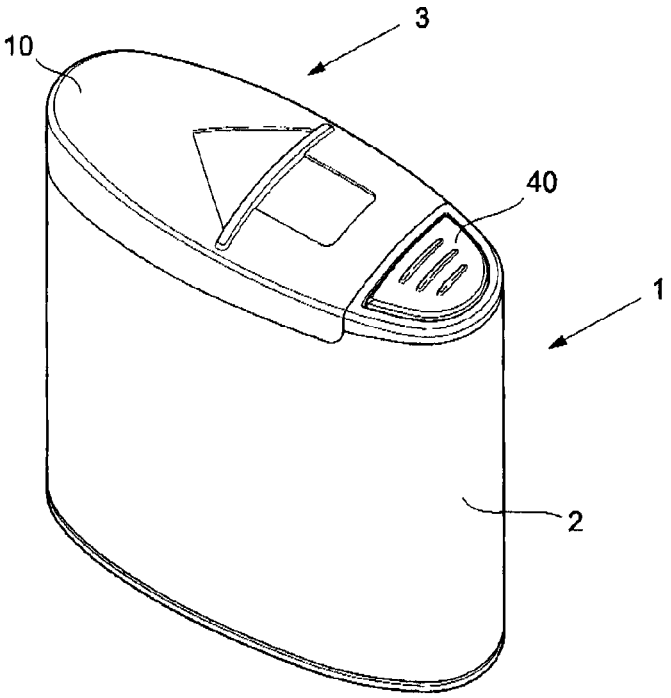
FIG. 9 shows a perspective view of a second embodiment of the container in the locked position.
Figure 10:
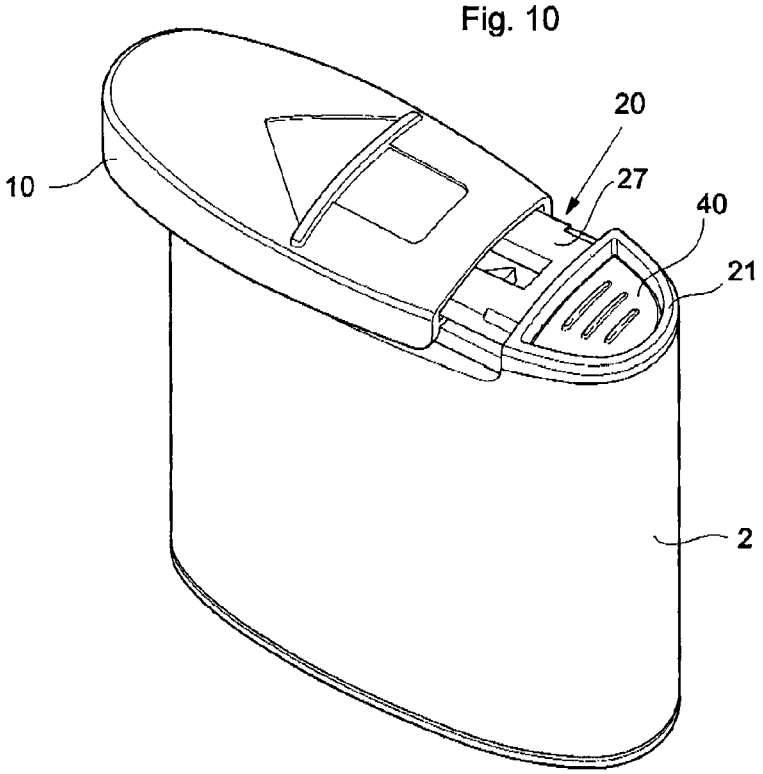
FIG. 10 shows a perspective view of a second embodiment of the container in the unlocked position and ready for opening.
Figure 11:
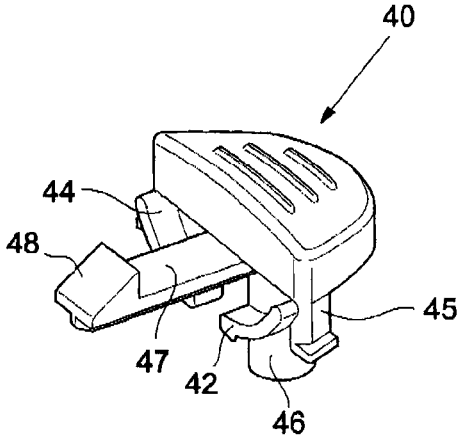
FIG. 11 illustrates a perspective view of a second embodiment of the locking member.

FIG. 9 shows a container according to a second embodiment in the closed and locked position. The container 1 has a closure 3 for closing the hollow body 2 and a locking member 40. To unlock the opening member 10 the locking member 40 has to be moved, i.e. depressed, see FIG. 10, and the opening member can then be slided out into the opening position. As is the case also in the first embodiment of the invention, the lid 20 of the second embodiment comprises a first section 21 fixed to the hollow body 2 and a second section 27, which is pivotally arranged to the first section around a hinge 28. FIG. 11 shows the locking member of the second embodiment of the present invention, which is in the form of a push button 40. The push button locks the opening member 10 in a non-depressed upper position by means of a catch 47 engaging the projecting member 16 on the inside of the opening member. The locking member 40 is arranged in the first section 21 of the lid 20.

The push button comprises a stem 46 for receiving the locking member in the upper wall 5 of the container and at least one leg 45 for keeping it in the appropriate place. It further comprises at least one actuator means 42, 44 and the catch 47 having an edge 48 in its distal end. Optionally, the locking member 40 is made of a colour different from the colour(s) used for the container 2 and/or opening member 10 such that it is easy for a user to spot.

Figure 12:
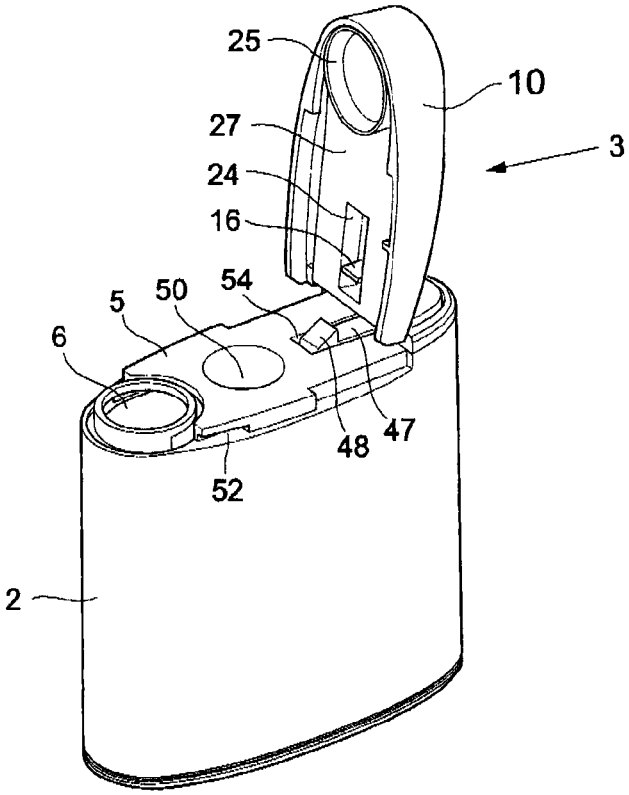
FIG. 12 illustrates a perspective view of a second embodiment of the container with the closure opened.

FIG. 12 shows the container of the second embodiment in a complete open position and content from inside the container, i.e. a tablet can be taken out via the access hole 6. A substantially circular recess 50 is provided in the upper wall 5 of the container for storing a dose, i.e. a tablet or a divided tablet. This can be convenient if the recommended dose is half a tablet. It is not advisable to put it back into the container, as it will be lost among the remaining doses.

Figure 13:
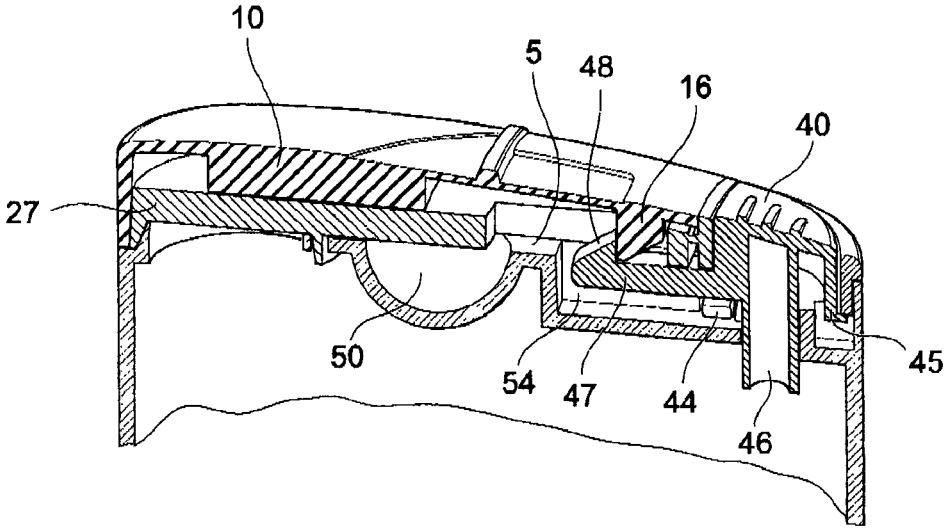
FIG. 13 shows a perspective view of the top of the container of a second embodiment having a piece of the closure cut out showing details on the locking member.

In FIG. 13 the locking engagement is shown in detail. The edge 48 of the catch 47 engages the projection 16 of the opening member. As a pressure is applied upon the locking member the actuator means 42, 44 are compressed and the catch is lowered whereby the projection 16 is released and the opening member is unlocked. When the pressing force is removed from the locking member it automatically returns to the raised position, i.e. the locked position shown in FIG. 9, due to a spring effect of the actuator means 42, 44. The actuator means consists of at least one resilient element 42, 44 but preferably two, arranged like curved legs to the locking member 40. In the upper wall 5 of the container a space 54 is arranged for receiving the stem 46 as well as the catch 47 and thus allowing the locking member 40 to be depressed enough to release the catch from the projection 16 on the opening member.

Figure 14:
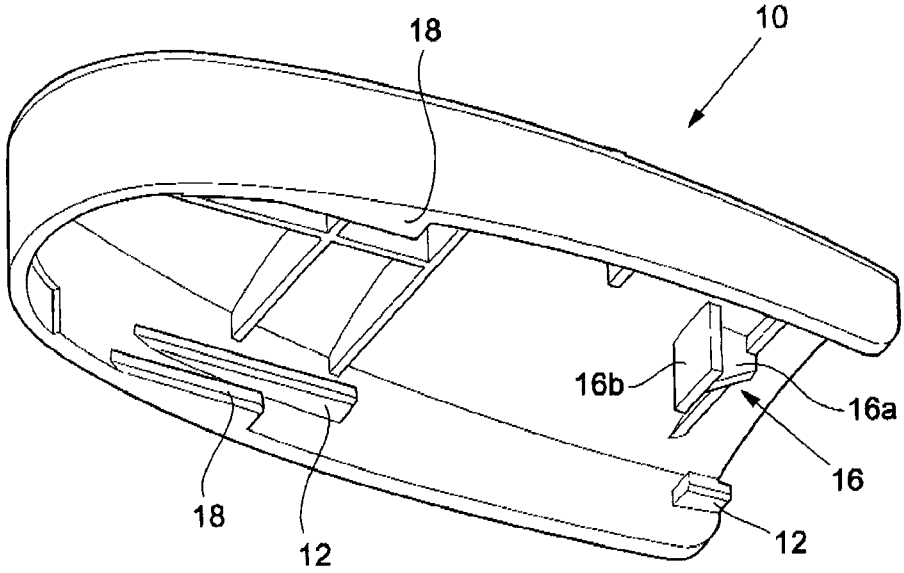
FIG. 14 illustrates a perspective view from underneath of the opening member of a second embodiment.

The opening member 10 for the second embodiment of the invention is shown in detail in FIG. 14. The projection 16 has a sloping part 16*a* and a rectangular portion 16*b*. The rectangular portion 16*b* is engaged in the locking of the opening member together with the edge 48 of the catch 47. The design of the sloping portion 16*a* makes it possible to slide back the opening member to the retracted position when closing the container without depressing the locking member 40. The catch being slightly resilient simplifies the passage of the edge 48 by the projection 16, such that the projection 16 smoothly passes the edge 48 when the opening member is slided back to the retracted position. As is the case in the first embodiment of the invention, the lid 27 has an elongate groove 24 for receiving the projection 16 such that the opening member can slide over the lid when moving the opening member to or from the unlocked position.

Further, it will be understood that the present invention is not limited to the described embodiments but can be modified in many different ways without departing from the scope of the appended claims.

The invention claimed is:

1. A container for pharmaceutical contents, the container comprising:

a hollow body having an access hole, wherein the hollow body holds the pharmaceutical contents, a closure that cooperates with the body to close the container, the closure comprising a hinge, a lid for sealing the access hole of the container, and an opening member that has a projection and is slidably attached to the lid and movable from a retracted position to an opening position in which the closure can be opened and in which an end of the opening member opposite from the hinge is extended for use as a lever for opening the closure, and a locking member for securing the opening member, wherein the locking member is movable with respect to both the body and the closure between a locking position in which the opening member is kept secured in the retracted position and an unlocked position in which the opening member is movable into the opening position, wherein the locking member, when in the locking position, blocks the projection, thereby preventing the opening member from moving into the opening position.

2. The container according to claim 1, further comprising an actuator means which automatically moves the locking member from the unlocked position to the locked position.

3. The container according to claim 2, wherein the actuator means automatically moves the locking member from the unlocked position to the locked position as the opening member of the closure is moved to the retracted position from the opening position.

4. The container according to claim 3, wherein the actuator means comprises a protruding part on the locking member which co-operates with a protruding edge on the opening member to move the locking member from the unlocked position to the locked position as the opening member is moved to its retracted position.

5. The container according to claim 4, wherein the protruding part is resiliently attached onto the locking member.

6. The container according to claim 2, wherein the actuator means comprises at least one spring member arranged on the locking member to automatically move the locking member from the unlocked position to the locked position.

7. The container according to claim 1, wherein the lid comprises a first section firmly attached to the body and a second section which is snap fitted to the body.

8. The container according to claim 7, wherein the first and the second sections of the lid are pivotally arranged to each other via a hinge.

9. The container according to claim 8, wherein the second section of the lid is provided with a sealing ring for sealing the access hole.

10. The container according to claim 1, wherein the opening member is provided with at least one lip that fits into at least one indentation in the container when the opening member is in the retracted position.

11. The container according to claim 1, wherein the opening member and the locking member are provided with indication marks.

12. The container according to claim 11, wherein the indication marks on the opening member and the locking member are aligned in the unlocked position.

13. The container according to claim 11, wherein the indication marks on the opening member and the locking member are not aligned in the locked position.

14. The container according to claim 11, wherein the indication marks are protruding from the material of the container such that they can be felt by touch.

15. A method of opening a container for pharmaceutical contents, the container comprising:

a hollow body having an access hole, wherein the hollow body holds the pharmaceutical contents, a closure that cooperates with the body to close the container, the closure comprising a hinge, a lid for sealing the access hole of the container, and an opening member, wherein the opening member is slidably attached to the lid and movable from a retracted position to an opening position in which an end of the opening member opposite from the hinge is extended and may be used as a lever for opening the closure, and a locking member which is movable with respect to both the body and the closure for locking the opening member, the method comprising the steps of:

a) moving the locking member with respect to both the body and the closure to an unlocked position, b) sliding the opening member in a lateral direction across the lid from the retracted position to the opening position, and c) opening the closure of the container by lifting the extended distal end of the opening member.

16. A container for holding pharmaceutical contents, the container comprising:

a hollow body having an access hole;

a closure that cooperates with the hollow body to selectively open or close the access hole, the closure having a lid configured to hinge about an axis on the hollow body and an opening member configured to slide along the lid between a retracted position and an opening position, wherein the opening member has a projection; and a locking member having a catch with an angled edge and a straight edge, the locking member being configured to translate between a first position in which the straight edge of the catch blocks the projection, thereby preventing the opening member from sliding along the lid, and a second position in which the straight edge of the catch does not block the projection, thereby allowing the opening member to slide along the lid;

wherein the angled edge of the catch is configured to urge the locking member into the second position when the opening member slides from the opening position to the retracted position.

17. The container of claim 16, wherein the lid is configured to seal the access hole of the container.

18. The container of claim 16, wherein the opening member is configured to be flipped upward upon being slid into the opening position.

* * * * *